US010805748B2

(12) United States Patent
Fichtl et al.

(10) Patent No.: US 10,805,748 B2
(45) Date of Patent: Oct. 13, 2020

(54) METHOD OF ADAPTING SETTINGS OF A HEARING DEVICE AND HEARING DEVICE

(71) Applicant: Sonova AG, Stafa (CH)

(72) Inventors: Elmar Fichtl, Uerikon (CH); Harald Krueger, Affoltern am Albis (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/094,979

(22) PCT Filed: Apr. 21, 2016

(86) PCT No.: PCT/EP2016/058852
§ 371 (c)(1),
(2) Date: Oct. 19, 2018

(87) PCT Pub. No.: WO2017/182078
PCT Pub. Date: Oct. 26, 2017

(65) Prior Publication Data
US 2019/0158969 A1 May 23, 2019

(51) Int. Cl.
*H04R 25/00* (2006.01)

(52) U.S. Cl.
CPC ..... *H04R 25/70* (2013.01); *H04R 25/505* (2013.01); *H04R 25/558* (2013.01); *H04R 2225/43* (2013.01); *H04R 2225/61* (2013.01)

(58) Field of Classification Search
CPC .. H04R 25/70; H04R 25/558; H04R 2225/43; H04R 2225/61
See application file for complete search history.

(56) References Cited

U.S. PATENT DOCUMENTS 8,135,138 B2 * 3/2012 Wessel ..... H04R 25/70 381/60
2003/0072465 A1 * 4/2003 Fischer ..... H04R 25/43 381/317
2010/0054510 A1 3/2010 Schumaier
(Continued)

FOREIGN PATENT DOCUMENTS

DE 19542961 C1 * 5/1997 ..... H04R 25/70

OTHER PUBLICATIONS

"FlexControl: Individualizing automatic performance", Phonak Insight, Jul. 2010, pp. 1-4.

(Continued)

*Primary Examiner* — Brian Ensey
(74) *Attorney, Agent, or Firm* — Pearne & Gordon LLP

(57) ABSTRACT

Provided is a method of adapting settings of a hearing device. The method includes the step of providing start settings and target settings of a user control, wherein the start settings and target settings define an effect of the user control at a start time and at an acclimatization completion time, and wherein the user control is for adjusting at least one setting of the hearing device. Further the method includes the steps of configuring an acclimatization transfer behavior of the user control from the start settings to the target settings, wherein the configuration defines how the settings, which determine an effect of the user control, change over time; and causing, during an acclimatization phase, the hearing device to adjust user control settings from the start settings to the target settings according to the configuration.

9 Claims, 4 Drawing Sheets

(56) References Cited

U.S. PATENT DOCUMENTS

2014/0146986 A1 5/2014 Ypma et al.

OTHER PUBLICATIONS

International Search Report for PCT/EP2016/058852 dated Mar. 15, 2017.
Written Opinion for PCT/EP2016/058852 dated Mar. 15, 2017.
"Determination of preferred parameters for multichannel compression using individually fitted simulated hearing AIDS and paired comparisons", Moore BC, Fullgrabe C. Stone MA, Sep.-Oct. 2011, retrieved on Nov. 8, 2019.

* cited by examiner

METHOD OF ADAPTING SETTINGS OF A HEARING DEVICE AND HEARING DEVICE

TECHNICAL FIELD

The present invention is related to a method of adapting settings of a hearing device by an end-user as well as a hearing device.

BACKGROUND OF THE INVENTION

Hearing devices are typically used to improve the hearing capability or communication capability of a user. A hearing device may pick up the surrounding sound with a microphone of the hearing device, processing the microphone signal thereby taking into account the hearing preferences of the user of the hearing device and providing the processed sound signal into an ear canal of the user via a miniature loudspeaker, commonly referred to as a receiver. A hearing device may also receive sound from an alternative input such as an induction coil or a wireless interface. Such hearing devices comprise user controls which provide only a limited range of modification patterns. Conventional volume control provides simply broadband gain adjustment for roughly adjusting loudness. Some user controls provide adjustments on perceptual dimensions like intelligibility and hearing comfort. However, these adjustment patterns remain the same over time—independent on changes in adjustment needs of the user.

In the course of fitting processes, e.g. a first time fitting process, hearing device users have to become familiar with new sound of new hearing instruments. A commonly known acclimatization management supports getting familiar with the new sound of a hearing device but does not support changes in the effect of the user control.

Commonly, also demands on modifications change during the process of the hearing device fitting. At the beginning of the fitting process, more familiar modification effects, like making simply louder and softer, may be desired, whereas at a later point in time a more intelligibility centred effect of the user control is required. Today the fitter can manually choose among conventional volume control and smarter controls. However, the user has to visit the fitter for any change in effect of the user control of a hearing device, which is cumbersome for the user and burdens the fitter with increased fitting effort resulting in increased costs.

It is therefore an object of the present invention to provide a method of adapting settings of a hearing device, which method allows to better support the end user needs and to reduce the fitting effort of the fitter. It is further object of the invention to propose a hearing system for performing such a method of adapting settings of the hearing device.

SUMMARY OF THE INVENTION

The present invention is directed to a method of adapting settings of a hearing device, wherein the method comprises the step of providing start settings and target settings of a user control, wherein said start settings and target settings define an effect of the user control at a start time and at an acclimatization completion time, and wherein said user control is for adjusting at least one setting of the hearing device. The method further comprises the steps of configuring an acclimatization transfer behavior of the user control from the start settings to the target settings, wherein said configuring step defines how the settings, which determine the effect of the user control, change over time; causing, during an acclimatization phase, the hearing device to adjust user control settings from said start settings to said target settings according to said configuration; and shifting a primary effect of the adjustment from a first parameter or a first set of parameters to a second parameter or a second set of parameters, wherein the first parameter or first set of parameters comprises at least one volume parameter, and the second parameter or second set of parameters comprises at least one of a noise canceller, a beamformer and a clarity-pleasantness parameter.

The present invention allows the fitter or user to configure start and target settings of the user control as well as the acclimatization transfer behavior, which defines how the settings, which determine the effect of the user control, change over time from the start settings to the target settings. In an example, the acclimatization transfer behavior can be a linear function for a plurality of included actuators, for example gain, sound cleaning actuators, etc. For example, the duration of the transfer, i.e. acclimatization time, can depend on the duration which is set for acclimatization management. In an example, the start setting of the user control preferably provides broadband loudness adjustment, e.g. conventional volume control, whereas the target setting provides adjustment on the perceptual dimension "intelligibility vs. hearing comfort", for Phonak hearing aids referred to as FlexControl. During the acclimatization phase, the method adjusts hearing device user control settings from said start settings to the target settings. For example, during the acclimatization phase, the user control continuously changes its settings, respectively, step-by-step from the start settings to the target settings. In one example, this change of user control settings depends on usage time of the hearing device. In another example, additionally or as an alternative, the change of user control settings is triggered by different triggers which are also used for acclimatization management. Hence, the present invention provides an evolving user interface allowing improved end user support as well as reduced fitting effort for the fitter. The user control modifies the hearing device settings according to the end user's needs, which needs may change during the fitting process with growing experience and familiarity with sound processing of the new hearing device. For the fitter, the need for modifying hearing device settings is reduced, resulting in reduced costs.

In an embodiment the proposed method further comprises the steps of: at the beginning of the acclimatization phase, causing the hearing device to apply user control adjustments to a plurality of programs executable on the hearing device; and subsequently applying user control adjustments to a specific program or a subset of said plurality of programs.

In a further embodiment the proposed method further comprises the step of, during the acclimatization phase, causing the hearing device to continuously change at least one setting of the user control from the start setting to the target setting in a gradual manner. For example, during acclimatization time, instead of changing settings of user control, effect of a user control input on hearing device settings is changed. In an example, at the begin of the acclimatization phase, user control adjustments (broadband gain adjustments) become applied globally to all programs. Subsequently, user control adjustments (frequency-shaped gain and sound cleaning adjustments) become applied only to such specific program or program mixture (e.g. in automat), which is currently active.

In an embodiment of the proposed method the at least one setting of the user control are changed from the start setting to the target setting in a linear, delayed gradual or stepwise manner. The acclimatization transfer behavior of the user control settings has not necessarily to be linear. In one example, the fitter can configure an individual course of acclimatization transfer function. In another example, the fitter can define separate acclimatization transfer behaviors for gain and for sound cleaning, e.g. sound cleaning adjustments become approachable and provided not before a certain time.

In a further embodiment the proposed method further comprises the step of associating the acclimatization transfer behavior of the user control with one or more of the following time-related measures: an accumulated hearing device use-time, a time span since acclimatization start time, in particular the initial fitting, a hearing device sound exposure measure, in particular a conversation time, and an experience-time measure based on a user adjustable experience or learning speed.

In further embodiments the proposed method further comprises the step of associating the acclimatization transfer behavior of the user control with one of the following user-interaction-related measures: a user interaction activity measure, in particular number of actuations of user control, a number of hearing device reboots, a user interaction preference measure, in particular a deviation of a neutral setting or a tendency towards a high setting or low setting, and a user selected acclimatization degree, in particular adjustable by an external device. In this aspect, the acclimatization transfer behavior of user control settings is not only dependent on usage time, but also on certain user control input patterns applied by the hearing device user. Such user control input patterns may comprise e.g. adjustments to the same direction vs. adjustments to different directions, each of the adjustments being applied by the hearing device user. In an example, the more consistent user control inputs are, the slower acclimatization transfer function of user control settings proceeds.

An exemplary method of operating a hearing device can comprise the steps of: determining if a configurable acclimatization criterion is fulfilled, and providing the user with at least one additional user control if the configurable acclimatization criterion is fulfilled.

The exemplary method can further comprise the step of associating the acclimatization transfer behavior of the user control with one or more of the following time-related measures: an accumulated hearing device use-time, a time span since acclimatization start time, in particular the initial fitting, a hearing device sound exposure measure, in particular a conversation time, and an experience-time measure based on a user adjustable experience or learning speed.

The exemplary method can further comprise the step of associating the acclimatization transfer behavior of the user control with one of the following user-interaction-related measures: a user interaction activity measure, in particular number of actuations of user control, a number of hearing device reboots, a user interaction preference measure, in particular a deviation of a neutral setting or a tendency towards a high setting or low setting, and a user selected acclimatization degree, in particular adjustable by an external device.

Moreover, the present invention is directed to a hearing system comprising a hearing device having a processor and a memory accessible by the processor, wherein said memory is adapted to store start settings and target settings of a user control, wherein said start settings and target settings define an effect of the user control at a start time and at an acclimatization completion time, and wherein said user control is for adjusting at least one setting of the hearing device, and wherein an acclimatization transfer behavior of the user control, said acclimatization transfer behavior defining how settings, which determine an effect of the user control, change over time, is configurable from the start settings to the target settings such to cause the hearing device, during an acclimatization phase, to adjust user control settings from said start settings to said target settings according to the acclimatization transfer behavior, wherein a primary effect of the adjustment is shifted from a first parameter or a first set of parameters to a second parameter or a second set of parameters, wherein the first parameter or first set of parameters comprises at least one volume parameter, and the second parameter or second set of parameters comprises at least one of a noise canceller, a beamformer and a clarity-pleasantness parameter.

The fitter or user of the inventive hearing device is allowed to configure start and target settings of the user control as well as the acclimatization transfer behavior which defines how the settings, which determine the effect of the user control, change over time from the start settings to the target settings. In an example, the start setting of the user control preferably provides broadband loudness adjustment, e.g. conventional volume control, whereas the target setting provides adjustment on the perceptual dimension "intelligibility vs. hearing comfort", for Phonak hearing aids referred to as FlexControl. During the acclimatization phase, the user control can continuously change settings, respectively, step-by-step from the start settings to the target settings. In one example, this change of user control settings depends on usage time of the hearing device. In another example, the change of user control settings is triggered by different triggers which are also used for acclimatization management. The proposed hearing device provides an evolving user interface allowing improved support for the user as well as reduced fitting effort for the fitter.

In an embodiment the proposed hearing system further comprises an external device operationally coupled to the hearing device, wherein said external device is adapted to configure the acclimatization transfer behavior.

In a further embodiment of the proposed hearing system the hearing device and/or the external device is further adapted to adjust the acclimatization transfer behavior from the start settings to the target settings. In a further embodiment of the proposed hearing system the external device comprises a smartphone.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is the following.

DETAILED DESCRIPTION OF THE INVENTION

Figure 1:
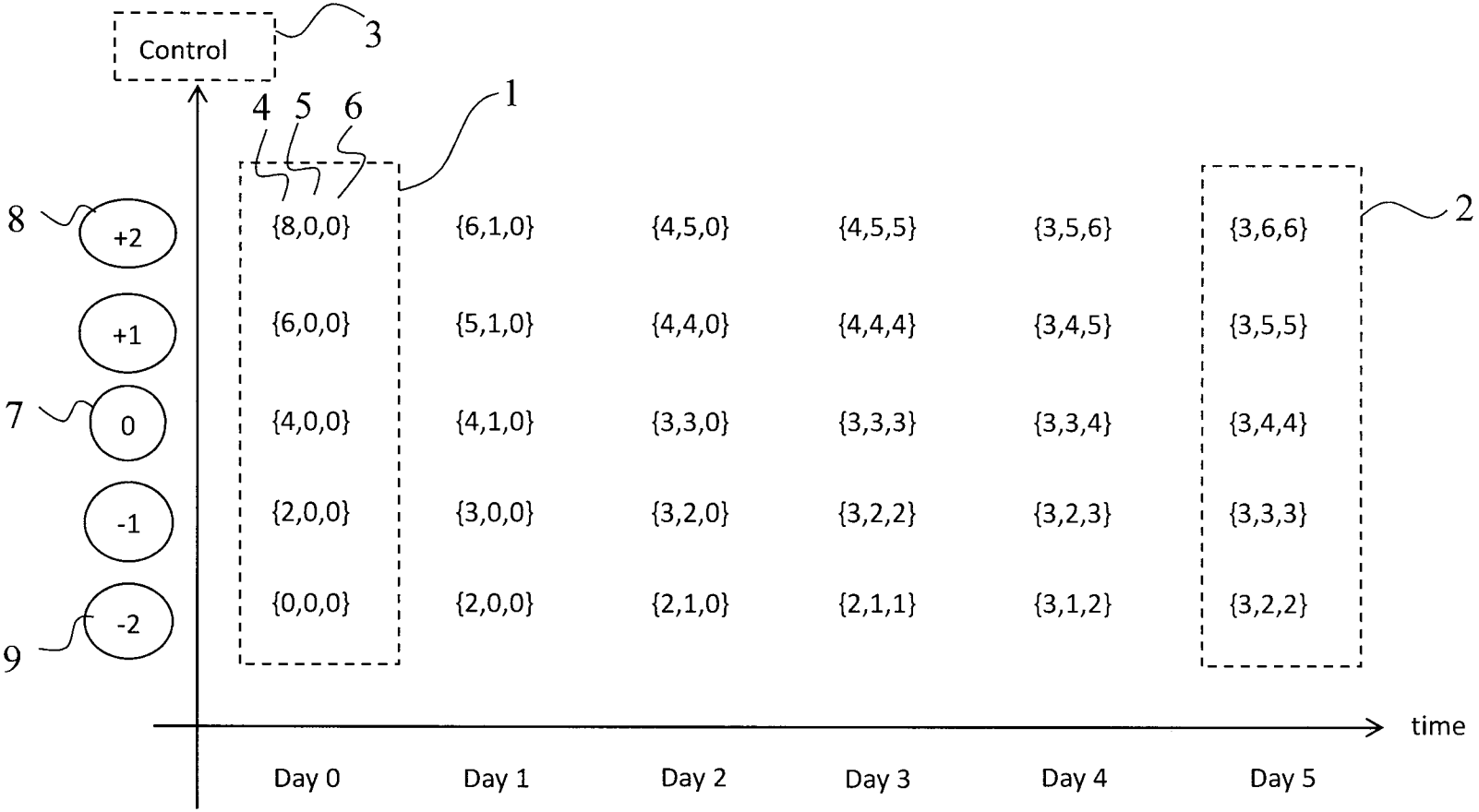
FIG. 1 is a schematic illustration depicting acclimatization user control, embodied as an absolute change of settings over time from start settings to target settings in an acclimatization transfer behavior of a user control.

FIG. 1 is an exemplary schematic illustration depicting a transition from start settings 1 to target settings 2 in an acclimatization transfer behavior of a user control 3 in an exemplary aspect. In particular, FIG. 1 shows an absolute change of settings 4,5,6 over time from said start settings 1 to said target settings 2.

In the shown example, the start settings 1, target settings 2 and intermediate settings are composed of a column, each comprising five setting-triplets including the three settings 4,5,6. The settings can include three actuators, e.g.: actuatorA 4, actuatorB 5, and actuatorC 6, respectively. In an example, actuatorA 4 corresponds to Volume, actuatorB 5 corresponds to Noise Canceller, and actuatorC 6 corresponds to Beamformer.

In the schematic illustration, the abscissa represents a time-axis partitioned in units of six days, i.e. from Day 0 to Day 5. The ordinate represents control 3 adjustments, wherein, in the shown example, the control 3 provides five absolute settings including neutral setting 7 as a medium setting (0), which is intermediate of a high setting 8 (+2) and a low setting 9 (−2). As shown in the exemplary illustration, having regard to the volume setting (actuatorA 4) on day 0, the low setting is set to be 0, the neutral setting 7 is set to be 4, and the high setting 8 is set to be 8. The intermediate setting between low setting 9 and neutral setting 7 is set to be 2, whereas the intermediate setting between high setting 8 and neutral setting 7 is set to be 6. On day 1, the absolute volume settings are adjusted from 2 (low setting) to 6 (high setting). On day 5, i.e. the (final) target setting 2, all volume settings are set to be 3. In the schematic illustration of FIG. 1, the settings 4,5,6 are changed over time (Day 0 to Day 5) from the start settings 1 to the target settings 2 in an absolute manner.

Figure 2:
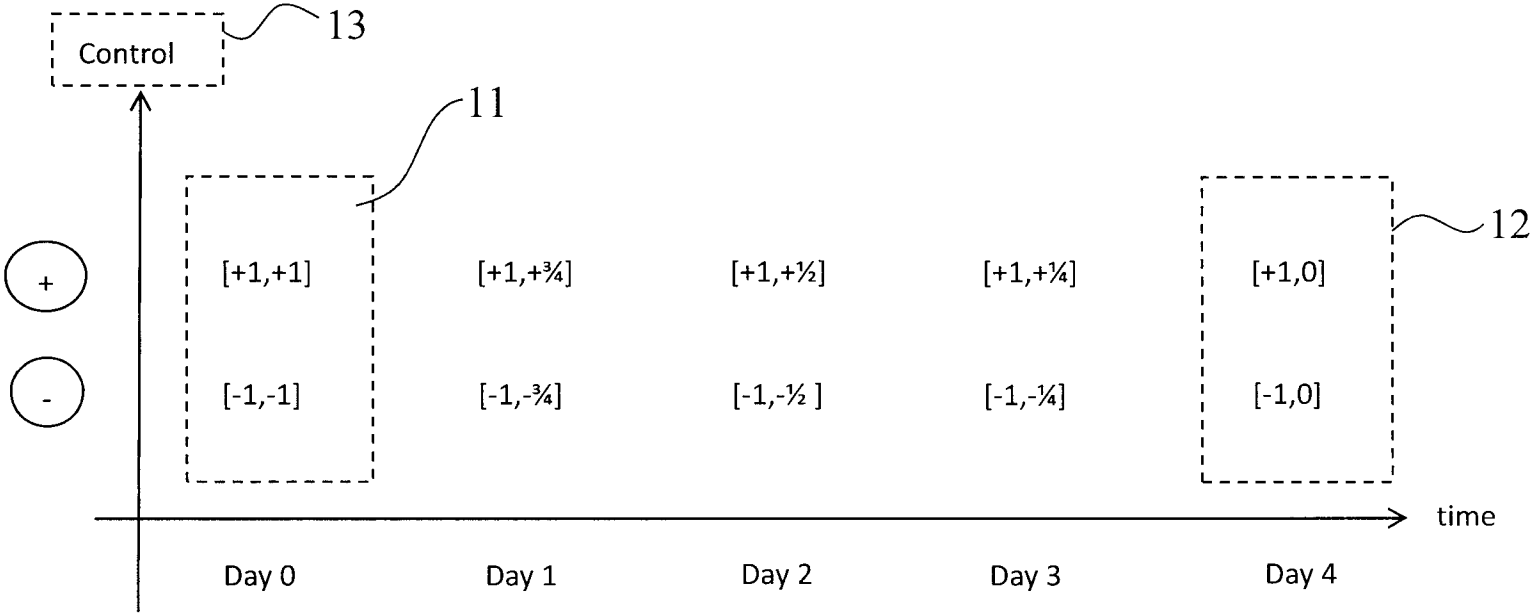
FIG. 2 is a schematic illustration depicting acclimatization user control, embodied as a relative change of settings over time from start settings to target settings in an acclimatization transfer behavior of a user control.

FIG. 2 shows a schematic illustration depicting acclimatization user control, embodied as a relative change of settings over time from start settings to target settings in an acclimatization transfer behavior of a user control. In particular, FIG. 2 shows a relative change of settings over time from start settings 11 to target settings 12. In the schematic illustration, the abscissa represents a time-axis partitioned in units of five days, i.e. from Day 0 to Day 4. The ordinate represents (relative) control 13 adjustments (−) and (+) which can be input by the user by means of manipulating a rocker switch mounted to the housing of the hearing device, for example.

Contrary to the settings as shown in FIG. 1, the settings in the embodiment as depicted in FIG. 2 can each comprise a volume setting in a calm environment, a volume setting used during a conversation (speech), and a volume setting used for listening to music. The settings can be represented by: {volume_calm, volume_speech, volume_music}. The settings shown in the illustration represent relative changes (Δ) to a (selected) active program and to other programs.

In an example, on Day 2, the active program is selected to be «Speech». Further, the volume can be set to be {1,1,1} (also refer to FIG. 1). Starting from these settings, if the user selects (+), the volume assumes: {1½,2,1½}. Otherwise, starting from the settings above, if the user selects (−), the volume assumes: {½,0,½}.

Figure 3:
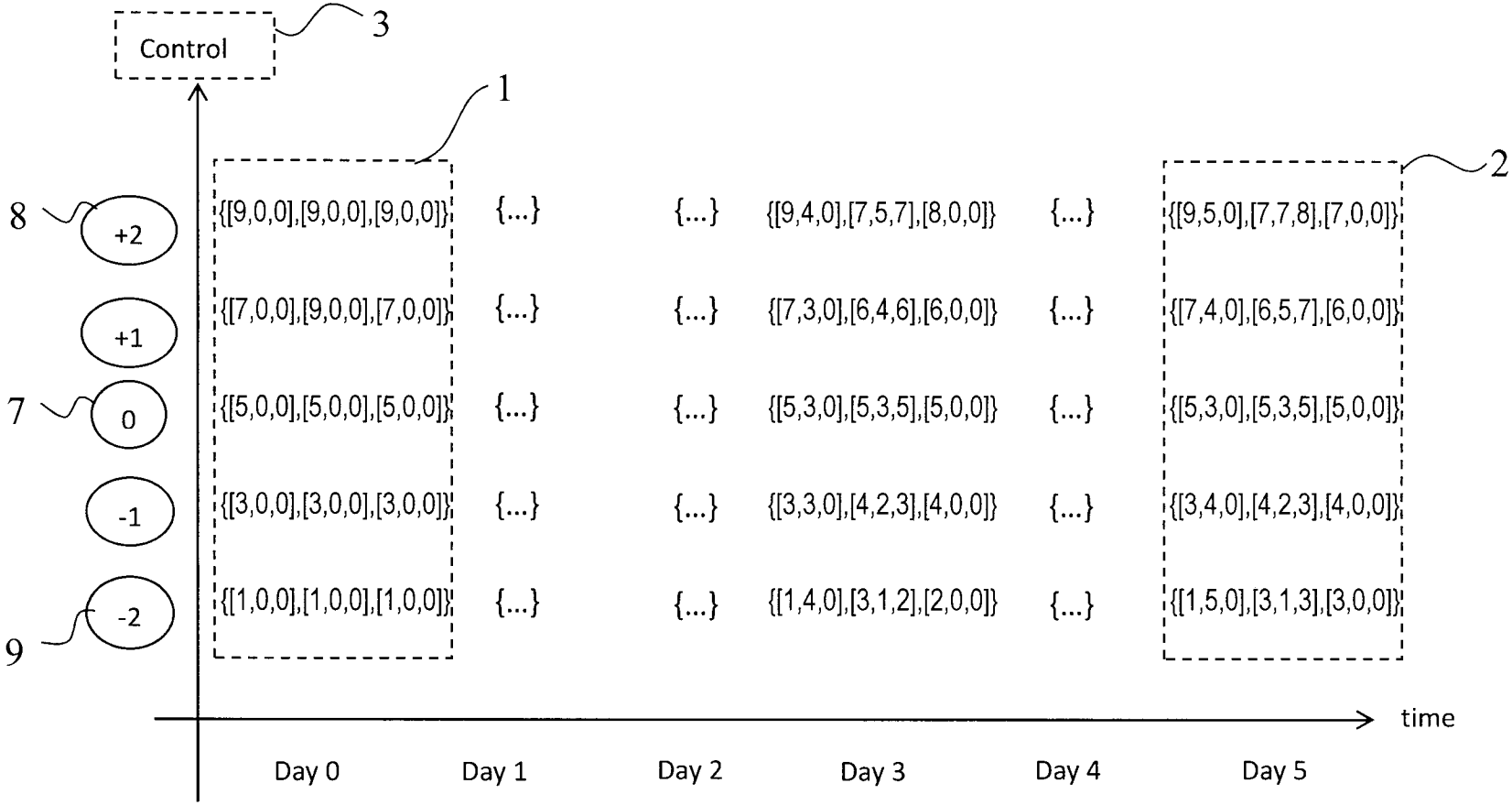
FIG. 3 is a schematic illustration depicting acclimatization user control, embodied as a change of settings for different programs over time from start settings to target settings in an acclimatization transfer behavior of a user control.

FIG. 3 is a schematic illustration depicting acclimatization user control, embodied as a change of settings for different programs over time from start settings 1 to target settings 2 in an acclimatization transfer behavior of the user control 3 (also refer to FIG. 1).

In the example as shown in FIG. 3, the start settings 1, target settings 2 and intermediate settings are composed of a column, each comprising five (absolute) stacks, each comprising three program setting triplets. The settings can include three actuators, e.g.: actuatorA, actuatorB and actuatorC, wherein e.g. actuatorA 4 corresponds to Volume, actuatorB corresponds to Noise Canceller and actuatorC corresponds to Beamformer (also refer to FIG. 1). The programs can comprise a volume setting in a calm environment, a volume setting used during a conversation (speech), and a volume setting used to listen to the music. Each respective stack can be represented by: {Prg1[actA,actB, actC], Prg2[actA,actB,actC], Prg3[actA,actB,actC]}. Hence, the user is allowed to perform settings in "volume", "noise canceller" and "beamformer" in three programs, i.e. "calm", "speech" and "music", respectively.

In the illustration, the abscissa represents the time-axis partitioned in units of six days, i.e. from Day 0 to Day 5. The ordinate represents control 3 adjustments, wherein, in the shown example, the control 3 provides five absolute settings including neutral setting 7 as a medium setting, which is between high setting 8 and low setting 9. In the schematic illustration of FIG. 3, the settings are changed over time (from Day 0 to Day 5) from the start settings 1 to the target settings 2 in an absolute manner.

Figure 4:
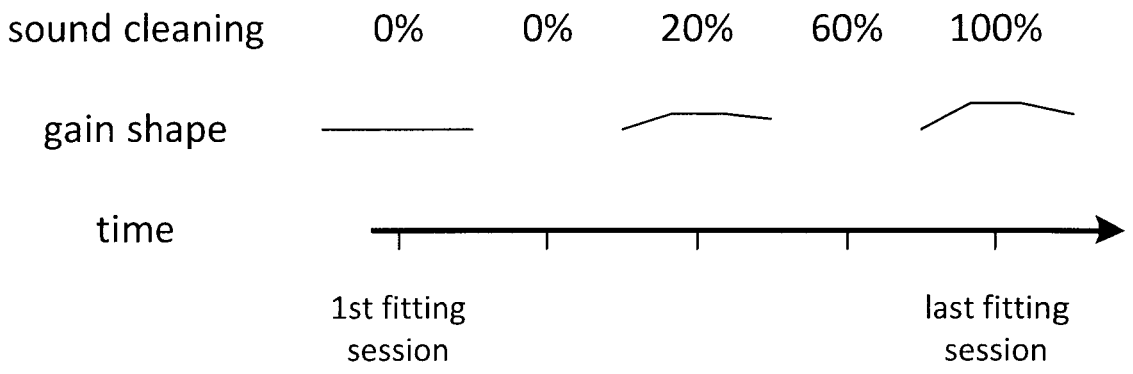
FIG. 4 is a schematic illustration depicting sound cleaning and gain shape in relation to time.

FIG. 4 is a schematic illustration depicting adjustment of sound cleaning and gain shape in relation to fitting sessions or time. The time axis of the acclimatization time period may be shown in days or, as shown in the FIG. 4, be divided in increments of fitting sessions, e.g. beginning from the first fitting session and lasting to the last fitting session.

In a first aspect, acclimatization transfer function of user control settings has not necessarily to be linear. Alternatively, the fitter configures an individual course of acclimatization transfer function or the fitter defines separate acclimatization transfer functions for gain and for sound cleaning. In an example, sound cleaning adjustments become approachable and provided not before a certain time is reached.

In a second aspect, during acclimatization time, instead of changing the settings of the user control, effect of a user control input on hearing device settings is changed. For example, at the beginning of the acclimatization phase, user control adjustments (broadband gain adjustments) become applied globally to all programs, later on user control adjustments (frequency-shaped gain and sound cleaning adjustments) become applied only to the specific program or program mixture (in automat), which is currently active.

In a third aspect, acclimatization transfer function of user control settings is not (only) dependent on usage time, but on certain user control input patterns (e.g. adjustments to the same direction vs. adjustments to different directions) applied by the hearing device user. In an example, the more consistent user control inputs are, the slower acclimatization transfer function of user control settings proceeds.

In a forth aspect, the end user has access to the configuration of the user control via an external device (e.g. a Smartphone, a remote control, etc.). The user is able to adjust the acclimatization transfer function or the effect of the user control in a certain range (e.g. increase or decrease speed of acclimatization transfer function).

The above-mentioned first to forth aspects relate to an interface sometimes called "evolving user interface" because of its evolving features. It is noted that any combination of the above-mentioned first to forth aspects can be subject of further possible aspects.

In a fifth aspect, besides of changing the behavior of a particular user control (e.g. slider), it is also possible to add additional user controls as the user becomes more familiar with the system over time. This might be especially relevant if the hearing device is controlled by a Smartphone.

For example, in the beginning, the user might be provided or rather offered to perform (only) a volume control. After e.g. one month, the user can be provided with at least one more additional user control. In the course of this, the user may be prompted with a message "You have been using the device for one month, do you want to further improve the adjustment by using an additional user control?".

User controls may be added for example in the following order:

| TIME AFTER INITIAL FITTING | USER CONTROL |
|---|---|
| Immediately | Volume |
| 1 Month | Manual Program Selection |
| 2 Months | Bass/Treble |
| 3 Months | Loudness Compression |
| 4 Months | Beamformer Strength/Direction |
| 5 Months | Frequency Compression |
| 6 Months | Time constants |

The following kinds of actions can be implemented:

The system simply shows a message for end-user training, for example explaining how to clean the hearing device The system asks, if a particular change to the user interface is to be applied The system adds a read-only "dashboard"-instrument, for example a sound level-meter The system adds an additional user control such as a beam former control The following kinds of triggers can be implemented:

A certain time or use time has elapsed since the first fitting or since the last action (user interface change)

The operation of a user control indicates that its way of functioning has been understood (e.g. a certain number of uses has been reached)

The hearing care professional has programmed a trigger for a specific date/time

The user actively indicates that he or she is familiar with the current system and is ready to advance or learn more The system (smartphone) based on a multitude of (sensor-)data, such as GPS, determines that the user may have time for training and/or coping with additional controls The following options and variations can be implemented:

The user may accept, reject or postpone changes to the user interface

The user may advance or go back to the acclimatization process (e.g. restart from the beginning)

The user and/or professional may select or change an acclimatization (user interface growth) speed Certain additional user controls may be have to be paid for The acclimatization (user interface growth) may be controlled by the hearing device, a smartphone app, via a server application and/or via HCP Additional user controls and/or instructions may be downloaded as modules from a server (which may not have existed yet at the time of initial fitting)

The last added user control may be prominent and/or large on a start-screen or dashboard, while other are rather small and/or hidden in submenus The present invention offers a functionality, which allows to better support the end user needs and to reduce the fitting effort of the fitter. For the fitter, the need for modifying hearing device settings is reduced. The user control modifies the hearing device settings according to the end user's needs, which may change during the fitting process with growing experience and familiarity with sound processing of new hearing devices.

What is claimed is:

1. A method of adapting settings (4,5,6) of a hearing device, the method comprising the steps of:

providing start settings (1) and target settings (2) of a user control (3), wherein said start settings (1) and target settings (2) define an effect of the user control (3) at a start time and at an acclimatization completion time, and wherein said user control (3) is for adjusting at least one setting (4,5,6) of the hearing device;

configuring an acclimatization transfer behavior of the user control (3) from the start settings (1) to the target settings (2), wherein said configuring step defines how the settings (4,5,6), which determine the effect of the user control (3), change over time;

causing, during an acclimatization phase, the hearing device to adjust user control settings from said start settings (1) to said target settings (2) according to said configuration; and shifting a primary effect of the adjustment from a first parameter or a first set of parameters to a second parameter or a second set of parameters, wherein the first parameter or first set of parameters comprises at least one volume (4) parameter, and the second parameter or second set of parameters comprises at least one of a noise canceller (5) or a beamformer (6);

at the beginning of the acclimatization phase, causing the hearing device to apply user control adjustments to a plurality of programs (11,12) executable on the hearing device; and subsequently applying user control adjustments to a specific program (11) of said plurality of programs (11,12) or a subset of said plurality of programs (11,12).

2. The method according to claim 1, further comprising the step of, during the acclimatization phase, causing the hearing device to continuously change at least one setting (4,5,6) of the user control (3) from the start setting (1) to the target setting (2) in a gradual manner.

3. The method according to claim 2, wherein the at least one setting (4,5,6) of the user control (3) is changed from the start setting (1) to the target setting (2) in a linear, delayed gradual or stepwise manner.

4. The method according to claim 1, further comprising the step of associating the acclimatization transfer behavior of the user control (3) with one or more of the following time-related measures:

an accumulated hearing device use-time, a time span since acclimatization start time, in particular the initial fitting, a hearing device sound exposure measure, in particular a conversation time, and an experience-time measure based on a user adjustable experience or learning speed.

5. The method according to claim 1, further comprising the step of associating the acclimatization transfer behavior of the user control (3) with one of the following user-interaction-related measures:

a user interaction activity measure, in particular number of actuations of user control (3), a number of hearing device reboots, a user interaction preference measure, in particular a deviation of a neutral setting (7) or a tendency towards a high setting (8) or low setting (9), and a user selected acclimatization degree, in particular adjustable by an external device.

6. A hearing system comprising a hearing device having a processor and a memory accessible by the processor, wherein said memory is adapted to store start settings (1) and target settings (2) of a user control (3), wherein said start settings (1) and target settings (2) define an effect of the user control (3) at a start time and at an acclimatization completion time, and wherein said user control (3) is for adjusting at least one setting (4,5,6) of the hearing device, and wherein an acclimatization transfer behavior of the user control, said acclimatization transfer behavior defining how settings (3,4,5), which determine the effect of the user control (3), change over time, is configurable from the start settings (1) to the target settings (2) such to cause the hearing device, during an acclimatization phase, to adjust user control settings from said start settings (1) to said target settings (2) according to the acclimatization transfer behavior, wherein a primary effect of the adjustment is shifted from a first parameter or a first set of parameters to a second parameter or a second set of parameters, wherein the first parameter or first set of parameters comprises at least one volume (4) parameter, and the second parameter or second set of parameters comprises at least one of a noise canceller (5), or a beamformer (6), wherein at the beginning of the acclimatization phase, the hearing device is configured to apply user control adjustments to a plurality of programs (11,12) executable on the hearing device; and wherein user control adjustments are subsequently applied to a specific program (11) of said plurality of programs (11,12) or a subset of said plurality of programs (11,12).

7. The hearing system according to claim 6, further comprising an external device operationally coupled to the hearing device, said external device is adapted to configure the acclimatization transfer behavior.

8. The hearing system according to claim 7, wherein the hearing device and/or the external device is further adapted to adjust the acclimatization transfer behavior from the start settings (1) to the target settings (2).

9. The hearing system according to claim 7, wherein the external device comprises a smartphone.

* * * * *